US009162779B2

(12) United States Patent
Dunivan et al.

(10) Patent No.: US 9,162,779 B2
(45) Date of Patent: Oct. 20, 2015

(54) PACKAGING APPARATUS AND METHOD

(75) Inventors: Steve Dunivan, Amarillo, TX (US); Ricky Jay Hudson, Amarillo, TX (US); Colby Shane Butcher, Amarillo, TX (US)

(73) Assignee: Plains Dairy, LLC, Amarillo, TX (US)

( * ) Notice: Subject to any disclaimer, the term of this patent is extended or adjusted under 35 U.S.C. 154(b) by 753 days.

(21) Appl. No.: 13/494,571

(22) Filed: Jun. 12, 2012

(65) Prior Publication Data

US 2012/0317932 A1 Dec. 20, 2012

Related U.S. Application Data

(63) Continuation-in-part of application No. 13/161,164, filed on Jun. 15, 2011, now Pat. No. 8,789,348.

(51) Int. Cl.

| | |
|---|---|
| ***B65B 7/20*** | (2006.01) |
| ***B65B 51/00*** | (2006.01) |
| ***B65D 5/66*** | (2006.01) |
| *B65D 77/04* | (2006.01) |

(52) U.S. Cl.

CPC . *B65B 7/20* (2013.01); *B65B 51/00* (2013.01); *B65D 5/6632* (2013.01); *B31B 2201/6095* (2013.01); *B65D 77/0426* (2013.01); *B65D 2577/043* (2013.01)

(58) Field of Classification Search

CPC ..... B65B 7/20; B65B 51/023; B65B 49/12; B65B 7/2807; B65B 7/2842; B65B 61/14; B65B 9/15; B31B 3/00; B31B 1/62

See application file for complete search history.

(56) References Cited

U.S. PATENT DOCUMENTS

| | | | | |
|---|---|---|---|---|
| 1,973,572 A | | 9/1934 | Leckband | |
| 2,297,284 A | | 9/1942 | Blackman | |
| 2,660,012 A | | 11/1953 | Boyce et al. | |
| 2,803,934 A | | 8/1957 | Lubersky | |
| 2,937,486 A | | 5/1960 | Ackley | |
| 3,055,156 A | | 9/1962 | Fox | |
| 3,261,144 A | | 7/1966 | Weber | |
| 3,394,529 A | | 7/1968 | Greenway | |
| 3,443,357 A | * | 5/1969 | Bacon et al. | 53/566 |
| 3,688,466 A | | 9/1972 | Geyer | |
| 3,779,448 A | | 12/1973 | Wootten | |
| 3,913,300 A | * | 10/1975 | Benzing | 53/287 |
| 4,896,480 A | | 1/1990 | Blumle | |
| 5,066,269 A | | 11/1991 | Center et al. | |
| 5,259,173 A | * | 11/1993 | Roberts et al. | 53/529 |
| 5,341,621 A | | 8/1994 | Martelli | |
| 6,598,380 B1 | * | 7/2003 | Sgubbi | 53/566 |

FOREIGN PATENT DOCUMENTS

| | | |
|---|---|---|
| EP | 0 057 592 A2 | 8/1982 |
| EP | 1 097 802 A2 | 5/2001 |

* cited by examiner

*Primary Examiner* — Sameh Tawfik

(74) *Attorney, Agent, or Firm* — Braxton, Hilton & Perrone, PLLC

(57) ABSTRACT

A method and apparatus are shown for securing a top for a cardboard carton where the carton has a bottom wall and integral sidewalls, an initially open interior and initially open top flaps with outwardly extending ears. The top flaps are folded to a carton closing position which closes off the initially open interior of the cardboard carton. The ears are also folded to a position in contact with the sidewalls of the carton. A set of punches are aligned with the folded ears of the carton and are actuated to force a first layer of cardboard from a respective top flap through an underlying region of the carton sidewall. A set of platens are located so as to underlie and reinforce the sidewalls of the carton as the punching operation takes place.

6 Claims, 10 Drawing Sheets

PACKAGING APPARATUS AND METHOD

CROSS-REFERENCE TO RELATED APPLICATIONS

This application is a continuation-in-part of earlier filed Ser. No. 13/161,164,, filed Jun. 15, 2011,, entitled "Packaging Apparatus and Method", by the same inventors.

BACKGROUND OF THE INVENTION

1.Field of the Invention

The present invention relates generally to packaging machinery and methods and, more specifically, to a method and apparatus for securing a lid to a cardboard box that has previously been loaded with a product.

2.Description of the Prior Art

A large number of machines exist at the present time which are capable of applying and securing lids to open top cartons as well as for folding and securing the initially open top flap or flaps of cartons filled with product. The existing devices include machines which serve to apply and form prescored lids about the openings of open-top cartons. Quite frequently, lids are presented to filled cartons in the form of prescored blanks having planar configurations. When the carton is of an open-top variety the blanks are extended across the carton top openings and then down-folded along score lines in a manner such that the peripheral portions of the lids engage the vertical side walls of the cartons.

In another type of packaging method, the top closure is provided in the form of a top flap or flaps developed from and integral with the container. Since the closure is integrally formed with the container, a mere folding operation is required to position the top flap or flaps over the initially open top.

In either type of packaging operation, it is customary to move empty cartons along a path on some type of conveyor system or by gravity in a chute. The cartons are either provided with closed integral side walls in an earlier carton forming operation, or the carton is formed as it moves down the conveyor line. As the cartons proceed along the path, product is placed in the carton. In the first method described above, a lid is applied to the open-top carton and the lid peripheral edges are folded and secured to the carton sidewalls. In the second of the previously described methods, the carton has an integral open top flap or flaps. The open top flaps of the carton are folded to make a closed top wall for the carton and the folded flaps are then secured to the sidewalls of the carton.

It is highly desirable that the previously described loading, closing and fastening operations proceed at a high rate of production. Continuous and reliable high speed loading of the cartons, applying of lids and closing of the top flaps is generally achieved at the present time, but the step of securing the carton top slows down the entire operation. For example, it is common at the present time to fasten the lid or top flaps by gluing them to the side walls of the carton. In addition to the start up and break down delays involved in handling glue, which is sticky and susceptible of change in viscosity during periods of inactivity, extra traveling space must be provided along the loading path to permit adequate time for the glue to set up and cure. This can result in a lower production rate. Perhaps more importantly, the cost of the glue used in the step of securing the carton top is a major expense in the overall packaging operation.

In order to overcome the disadvantages of gluing, cartons have been devised with tongues on certain flaps which cooperate with notches or grooves in other flaps of the carton. The tongues are engaged and forced into a locking fit in the grooves or notches in order to secure the carton top. See, for example, U.S. Pat. No. 2,937,486, to Ackley, issued May 24, 1960. This approach decreases some of the difficulties associated with gluing. However, the Ackley process continues to present certain difficulties. Because the carton body and flaps were pre-punched, it was necessary to insure that the notches and flaps were precisely aligned at all times. Otherwise, the punching procedure may tend to bruise or buckle the cartons because of the misalignment, or the closing operation might fail entirely.

It is therefore an object of the present invention to provide an improved apparatus and method for folding and securing the initially open flaps of an open-top carton to the main body of the carton to thereby provide a secure closure for the carton.

Another object of the invention is to provide such an apparatus and method which can be used to secure separate carton lids to an open top carton.

It is another object of the present invention to provide a device of the character stated which is extremely versatile in usage being adapted for integration with a variety of assembly line operations and, hence, be readily incorporated into existing equipment without requiring costly modifications.

It is a further object of the present invention to provide a device of the character stated which incorporates a minimum of additional components and which is readily adapted for automatic operation in cooperation with any of a number of suitable hydraulic or pneumatic power drive sources and which is, hence, capable of operating at predetermined rates commensurate with a particular packaging operation so that it does not impede or restrict the designed volume flow of the related equipment.

It is a still further object of the present invention to provide a device of the character stated which can be economically manufactured, which is resistant to breakdown, and which is extremely durable and reliable in usage.

Additional objects, features and advantages will be apparent in the written description which follows.

SUMMARY OF THE INVENTION

The apparatus of the present invention can be used in a packaging method which obviates the above difficulties and meets the foregoing objects. In one preferred form, the apparatus is used for folding and securing a top for a cardboard carton where the carton has a bottom wall and integral sidewalls defining an initially open interior and initially open top flaps with outwardly extending ears, the initially open top flaps being integrally formed with a first pair of opposing sidewalls of the carton. The apparatus forms a part of an assembly line mechanism and is located downstream of a carton closing station which receives a cardboard carton with top flaps which have been folded downwardly from an initially open position to a carton closing position which closes off the initially open interior of the cardboard carton. The outwardly extending ears of the now closed top flaps are also in a position in contact with a second set of opposing sidewalls of the carton intermediate the first set of opposing sidewalls. Alternatively, the apparatus may form a part of the carton closing station.

The assembly line mechanism includes a carton punching mechanism for punching and forcing a first layer of cardboard from the ear of a respective top flap through an associated second layer of an underlying sidewall of the carton, whereby the first layer of cardboard forms a retainer for the respective top flap ear to thereby secure the ear and flap to the respective sidewall of the carton. The carton punching mechanism is carried by a vertically movable carriage. In one version of the invention, the punching mechanism includes a horizontal shaft carried between a pair of spaced apart trunnions, the shaft also carrying a set of punches which are alignable with the folded ears of the top flap. The punches terminate in die elements. In one version of the invention, the punches are rotatable about the shaft. In another version of the invention, the punches are again carried by the vertically movable carriage. However, in this version, the punch elements are movable between retracted and extended positions along a horizontal axis. The vertically movable carriage also carries a pair of spaced apart, vertically extending platens. The platens are spaced apart a selected distance so as to underlie the inwardly extending die elements of the punches when the punches are actuated to punch the carton. The platens have window openings located in such a way as to receive the die elements as the carton is punched.

A suitable power source is provided for effecting vertical movement of the traveling carriage and for effecting movement of the punches. The traveling carriage acts as a vertical elevation mechanism which effects vertical movement of the punches along a vertical path of travel with respect to the stationary carton. The platens are suitably spaced so as to puncture the carton top flaps and enter the carton interior upon vertical movement of the carton punching mechanism, prior to the punching operation, as the carton closing operation proceeds.

The previously described apparatus is used as an assembly line mechanism in the practice of the method of the invention to securely engage the initially open top flaps on a cardboard carton, as will be described in greater detail in the written description which follows. The apparatus can also be used to engage a separate, non-integrally formed lid with an open top cardboard carton.

Additional objects, features and advantages will be apparent in the written description which follows.

DETAILED DESCRIPTION OF THE INVENTION

Figure 1:
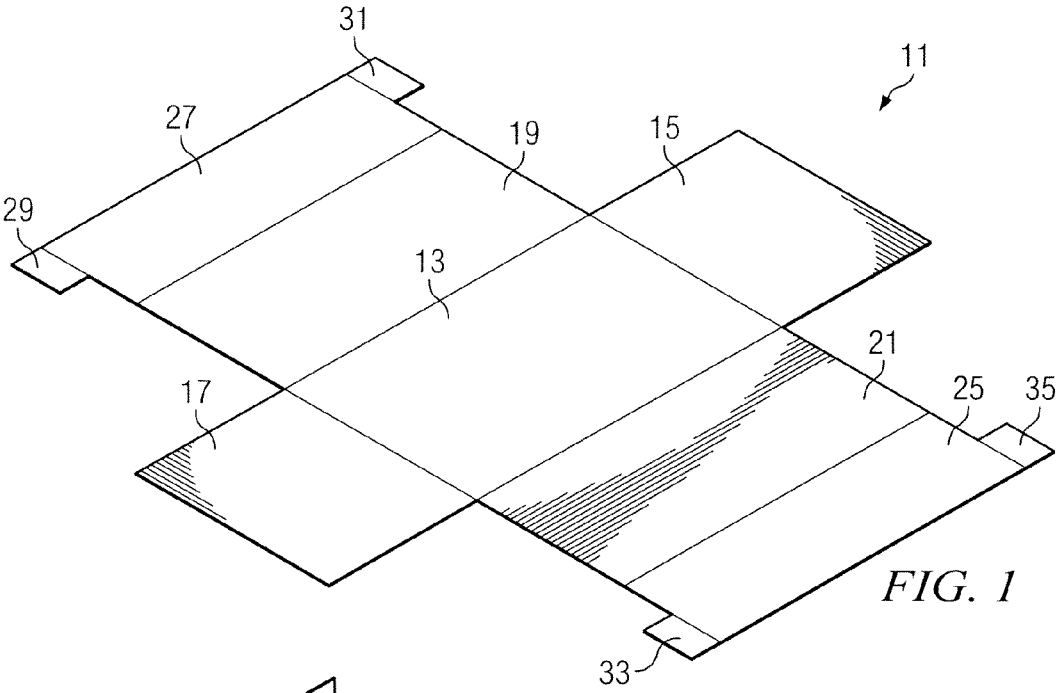
FIG. 1 is an elevational view of a cardboard carton blank of the type used in the practice of the method of the invention.

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the important features of the invention. The examples used herein are intended merely to facilitate an understanding of ways in which the invention herein may be practiced and to further enable those of skill in the art to practice the embodiments herein. Accordingly, the examples should not be construed as limiting the scope of the claimed invention.

The lid closure apparatus of the invention can be used in a variety of packaging assembly lines. These packaging assembly lines include both those which use separate lids and those which use cartons with integrally formed initially open flaps which are later folded and secured to form a top for the carton. Both types of packaging lines are well known in the industry and are commonly used, for example, in packaging milk cartons or jugs for shipment. The present discussion will not include a detailed explanation of the steps in preparing the carton for the actual puncture and engagement steps, since such processes and devices used therein are well known in the relevant arts. A number of prior art packaging lines are known for accomplishing this task.

For an example of the first type of packaging line, the reader is referred to U.S. Pat. No. 5,369,939, issued to Lewis et al., on Jun. 9, 1987, by way of example, which describes a packaging framework having a high speed endless belt conveyor passing through a lidding station. A gate at the entrance into the conveyor is cyclically opened and closed to periodically admit a preloaded carton into the lidding station. Within the lidding station, an elongate brake shoe incorporates a stop member to arrest the carton in an indexed position. The carton is laterally restrained between a pair of fixed guides on opposite sides of the conveyor belt and, after the carton has been arrested by the stop blocks of the elongated brake shoes, a pair of back blocks are laterally swung into contact with the trailing end of the indexed carton.

Each of the brake shoes is mounted on a pivotal axis paralleling the brake shoe and the adjacent carton bottom edge. A double pneumatic cylinder is used to raise the carton in two steps from the retracted position into intermediate and fully elevated positions. In the intermediate position, the brake shoes lift the carton from the conveyor and serve to gradually decelerate the carton until it engages the downstream stop blocks, the carton sliding on the horizontal flanges of the brake shoes. In the fully extended position the carton is further lifted away from the conveyer belt and raised into a fully indexed position and clamped between vertical flanges of the pair of shoes in readiness for application of a lid thereto.

The lidding station has a lateral frame section comprising a magazine for preformed blanks that have been cut and scored in readiness to be formed as a lid around the upper end of the indexed carton. The lid blanks are individually retrieved from a stack thereof by a vacuum cup assembly to deliver the lid blank onto a shuttle mechanism that transports the lid blank through a glue application station into an indexed position within a fold and compression sub-assembly. The fold and compression assembly includes an opposite pair of longitudinally grooved guide rails to receive opposite edges of a lid blank as well as a pair of stops to arrest the blank in the indexed position. In the indexed position of the lid, the fold lines of its marginal flaps and tabs are in registration with the upper end of the elevated and loaded carton. The fold and compression assembly is mounted for vertical reciprocation by means of a linear thruster on the machine framework and acts to apply a compressive force against the top surface of the lid and onto upper edge portions of the carton corner posts so that the lid can be glued to the carton.

The details of the above process are merely intended to describe a typical lidding operation for packaging lines having open top cartons and separate lids. The closure station of the invention would typically be incorporated into the packaging line after the lid has been positioned on the open top carton.

An example of the second type of packaging line which uses a carton with integrally formed, initially open top flaps is shown, by way of example, in U.S. Pat. No. 2,937,486, to Ackley, issued May 24, 1960. In that packaging line, empty cartons are moved along a path on a conveyor. The cartons are provided with closed integral side walls and open top flaps. As the cartons proceed along the path, cylindrical cans are placed in the carton, the top flaps of the carton are folded to make a closed top for the carton, and the top flaps are then secured to seal the carton.

Again, the details of this process are merely intended to be illustrative of the second type packaging line in which the lid is integral with the carton sidewalls.

Figure 2:
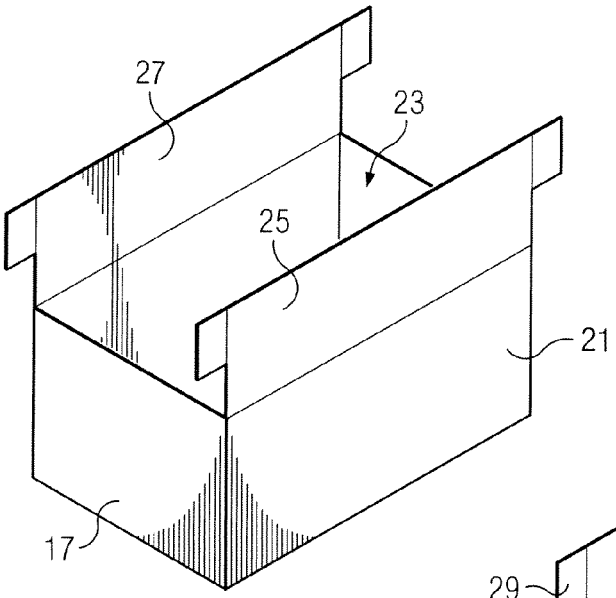
FIG. 2 is a perspective view of the same carton blank which has been folded and sealed to form a carton having upstanding sidewalls and open top flaps.

Turning now to FIG. 1, there is shown a cardboard carton blank of the type used in the practice of the present invention, designated generally as 11. The blank 11 has what will become a bottom wall 13, and pairs of opposing sidewalls 15, 17 and 19, 21. The integral sidewalls 15, 17 and 19, 21 define an initially open interior (designated generally as 23 in FIG. 2) when the carton body is assembled. Note that the opposing sidewalls 19, 21 have initially open top flaps 25, 27 at an outer extent thereof. The flaps are integrally formed with the first pair of opposing sidewalls of the carton 19, 21. Each of the flaps has a pair of spaced-apart, initially outwardly extending ears 29, 31 and 33, 35. When the carton body has been assembled, as shown in FIG. 2, the initially open top flaps 19, 21 are vertically disposed.

Figure 3:
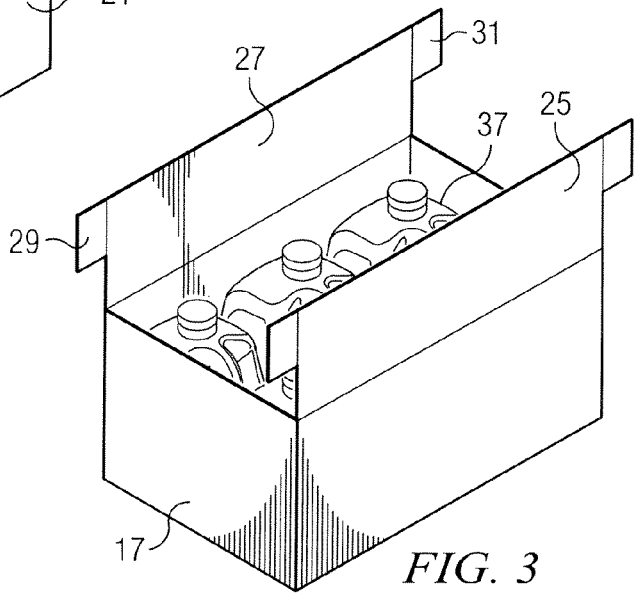
FIG. 3 is a view of the carton of FIG. 2 filled with milk jugs and with the top flaps in the open, unengaged position.
Figure 4:
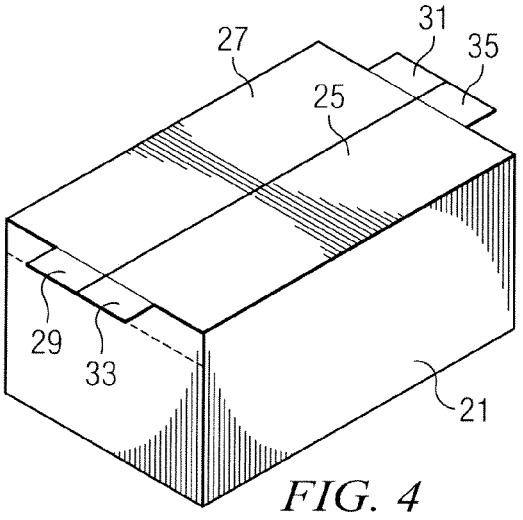
FIG. 4 shows the next step in forming a closed carton in which the initially open top flaps of the carton are folded down to form a closed top for the carton.
Figure 5:
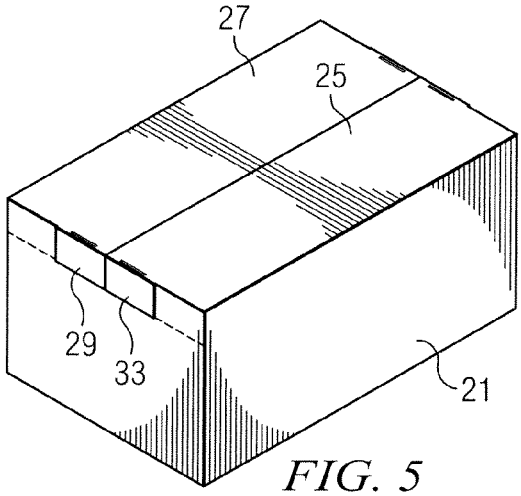
FIG. 5 is a view of the next step in forming a closed carton in which the ears of the initially open top flaps are punched and engaged with the carton sidewalls.

FIG. 3 shows the carton which has been filled with plastic milk jugs 37. In a typical milk carton packaging operation, the carton body is formed from the blank shown in FIG. 1. As the carton passes down a conveyor, the milk jugs 37 and positioned in the carton interior at a fill station. At a subsequent station in the packaging line, the carton top flaps are folded down to the position shown in FIG. 4. A line of glue would then typically be applied along the carton sidewalls, as indicated by dotted lines in FIGS. 4 and 5. The initially outwardly extending ears of the top flaps would then be folded down, as shown in FIG. 5, and pressure would be applied to seal the ears 29, 33 as the glue cured.

Figure 6:
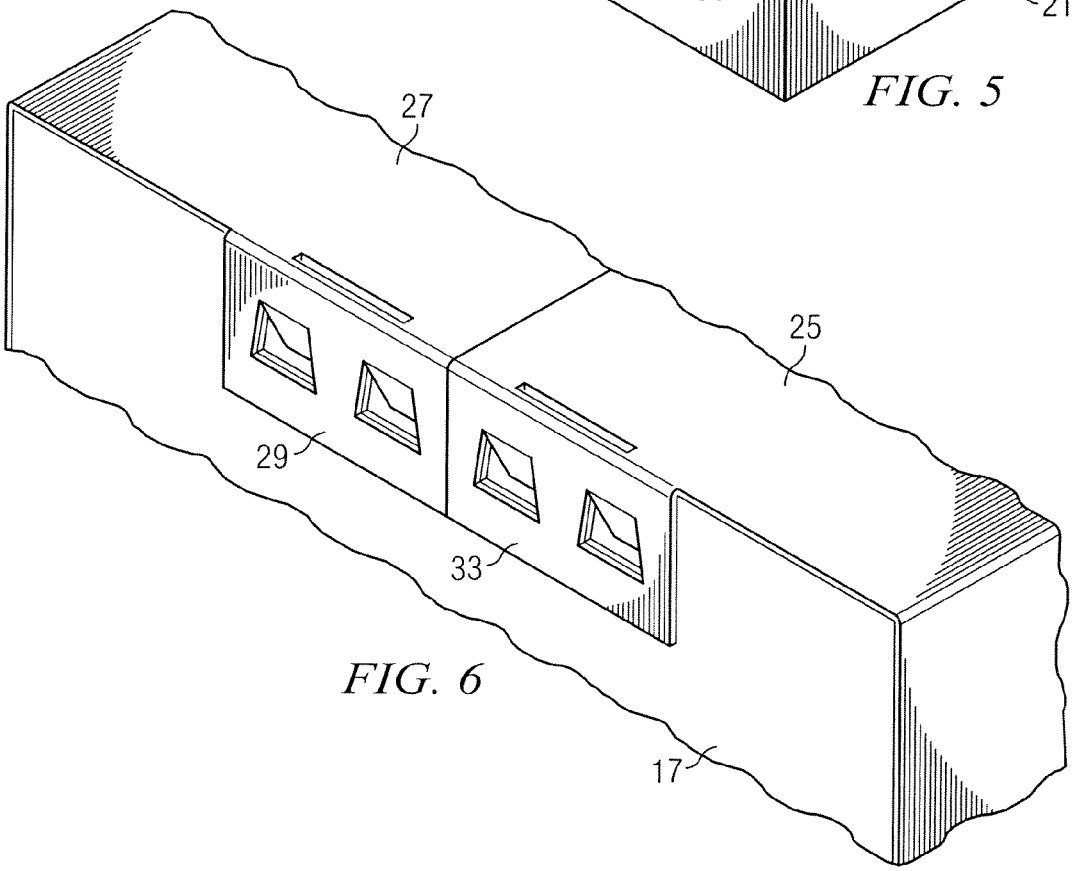
FIG. 6 is a close up view of the punched and engaged region of the carton.

All of the above steps are conventional in the industry and the associated machinery used to accomplish these tasks will not be discussed further, except as might bear on the closure station which forms the essence of the present invention. FIG. 6 shows a cardboard carton which has been sealed using the method and apparatus of the present invention, rather than using a gluing station, as practiced in the prior art. The closure station of the invention would thus follow the steps in the packaging process indicated in FIGS. 4 and 5 where the top flaps and associated ears have been folded down. However, the closure station of the invention would take the place of the glue application illustrated schematically in FIGS. 4 and 5.

Figure 7:
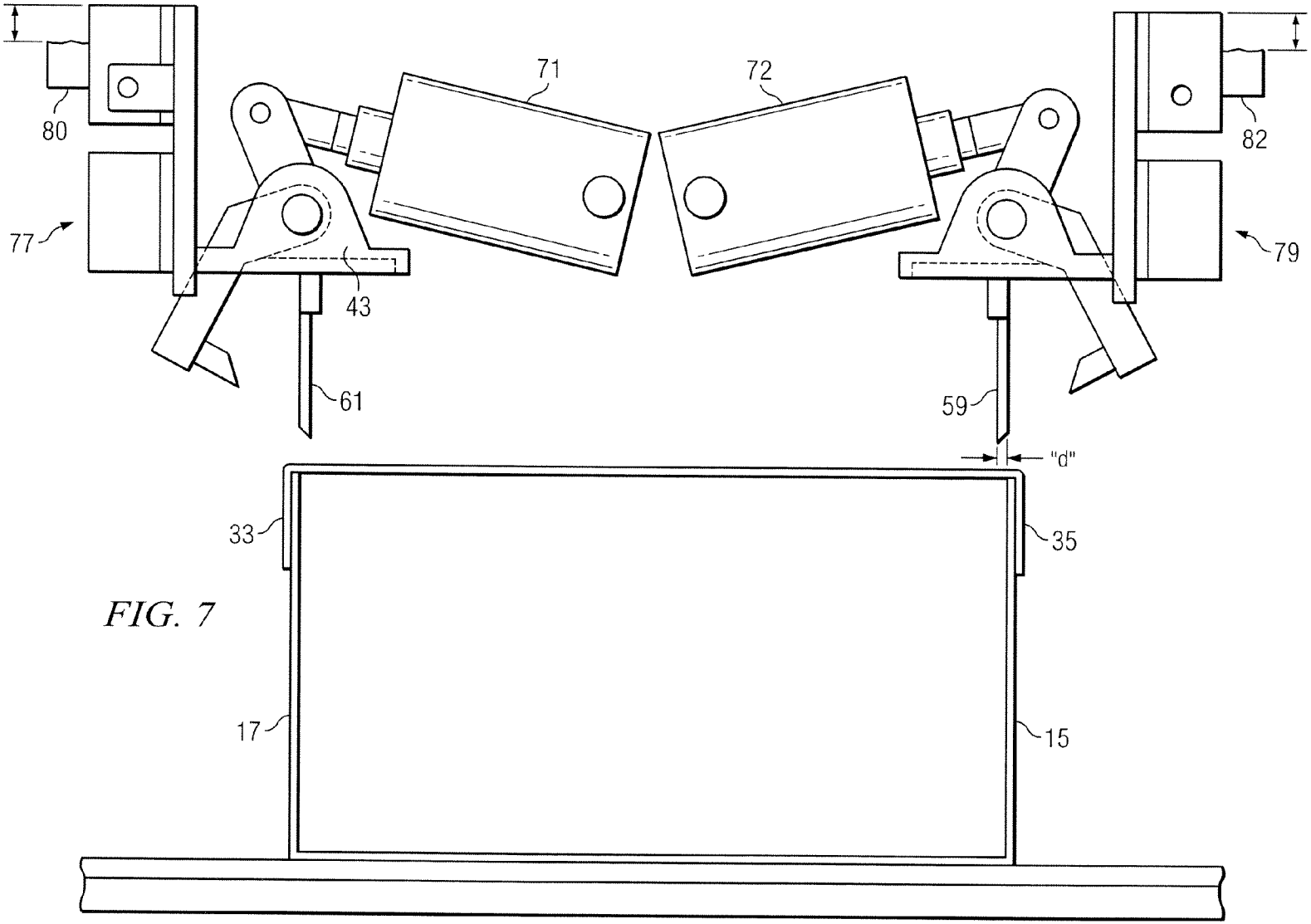
FIGS. 7-9 are simplified, schematic views of the various sequential steps in the method of the invention, showing the operative parts of one version of the carton punching mechanism of the invention.
Figure 8:
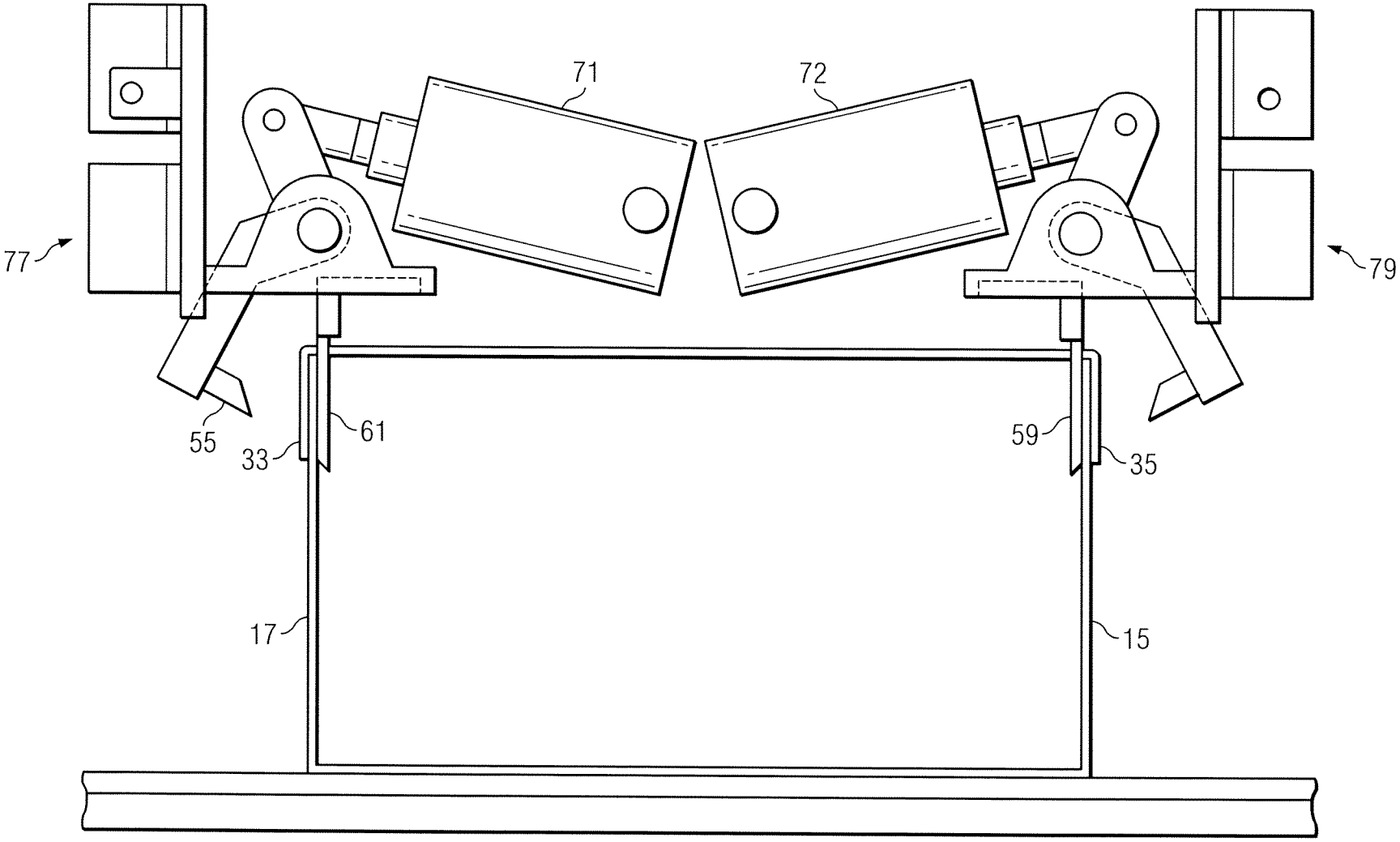
Figure 9:
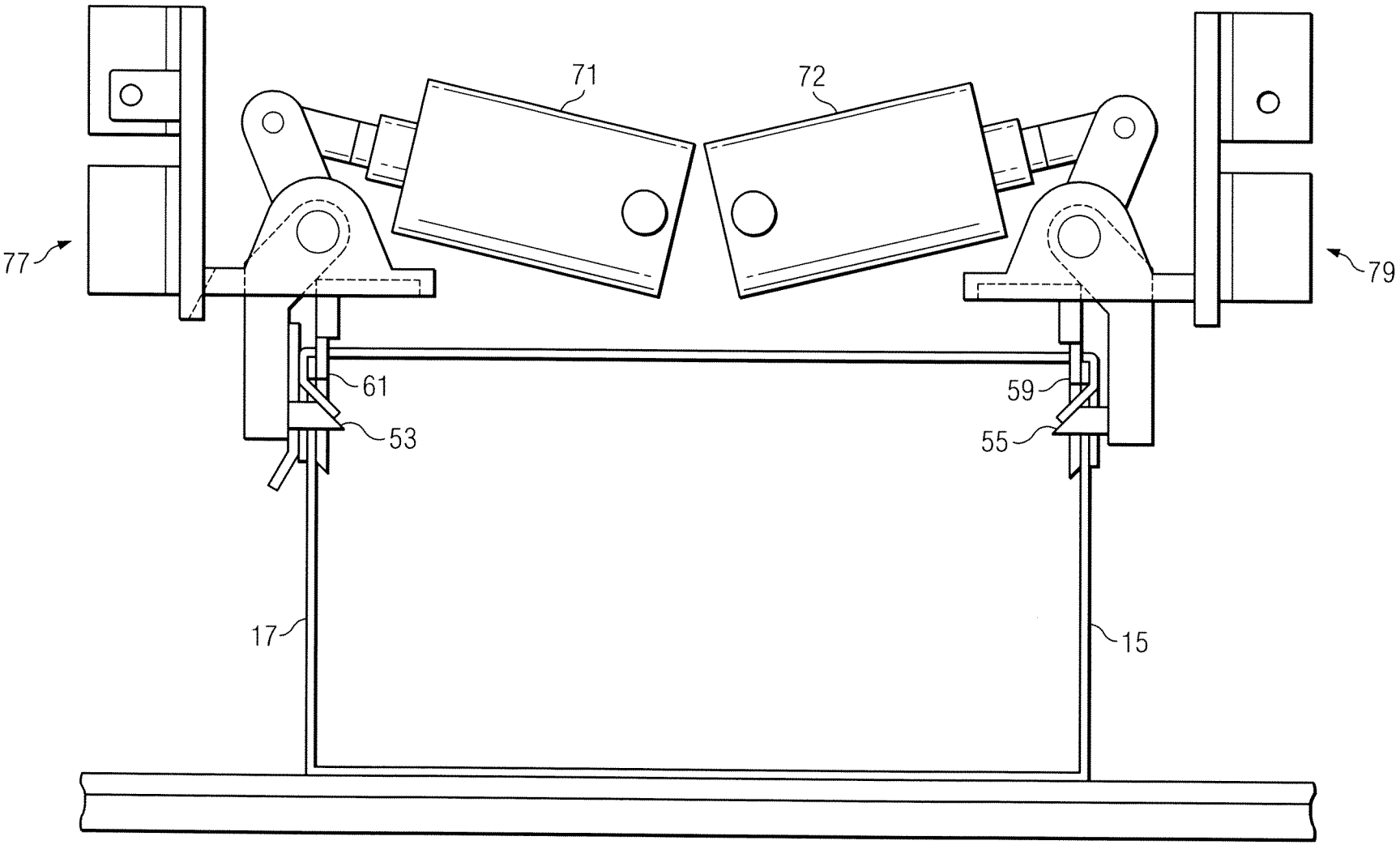
Figure 10:
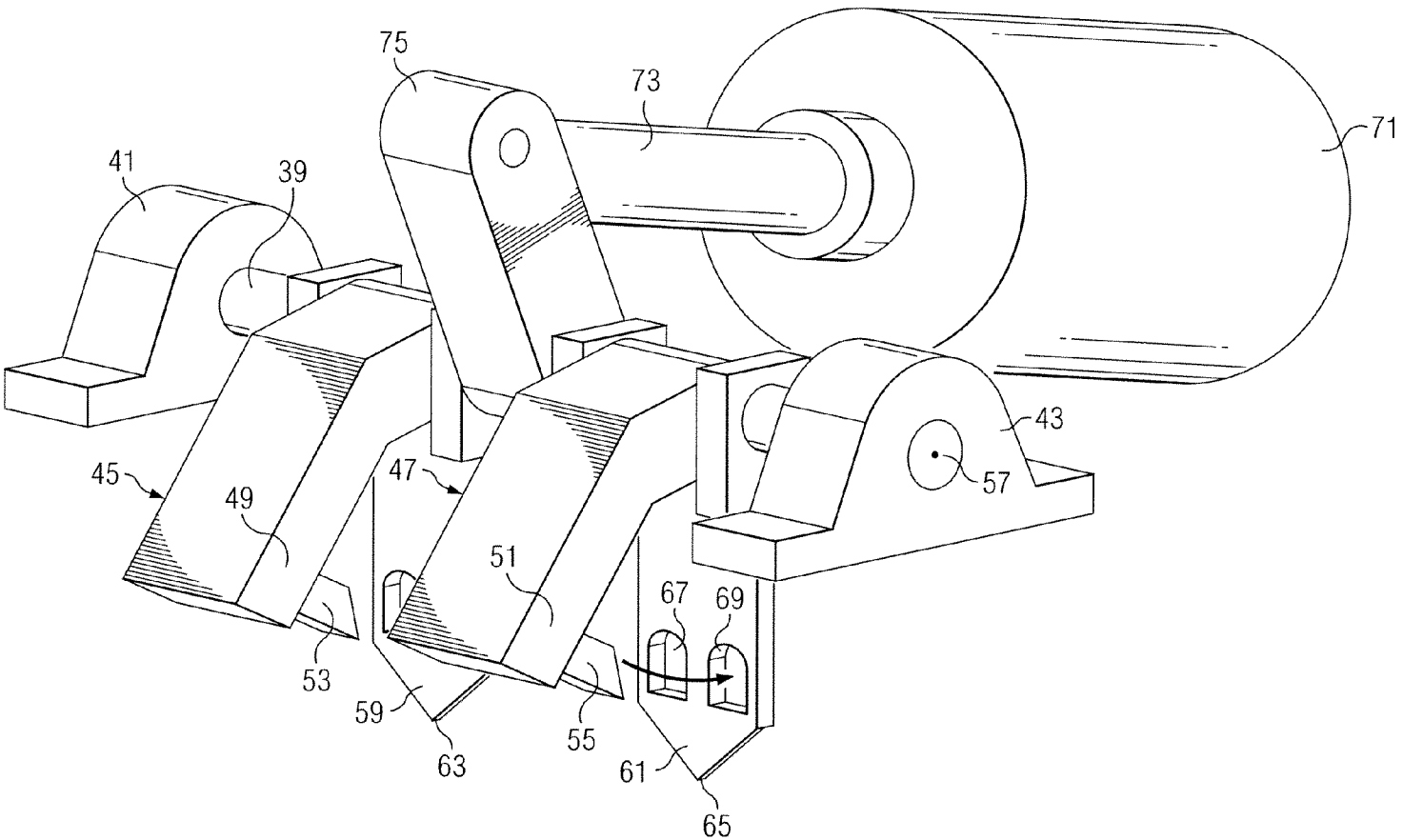
FIG. 10 is an isolated, close up view of the first version of the carton punching and engaging apparatus of the invention.
Figure 11:
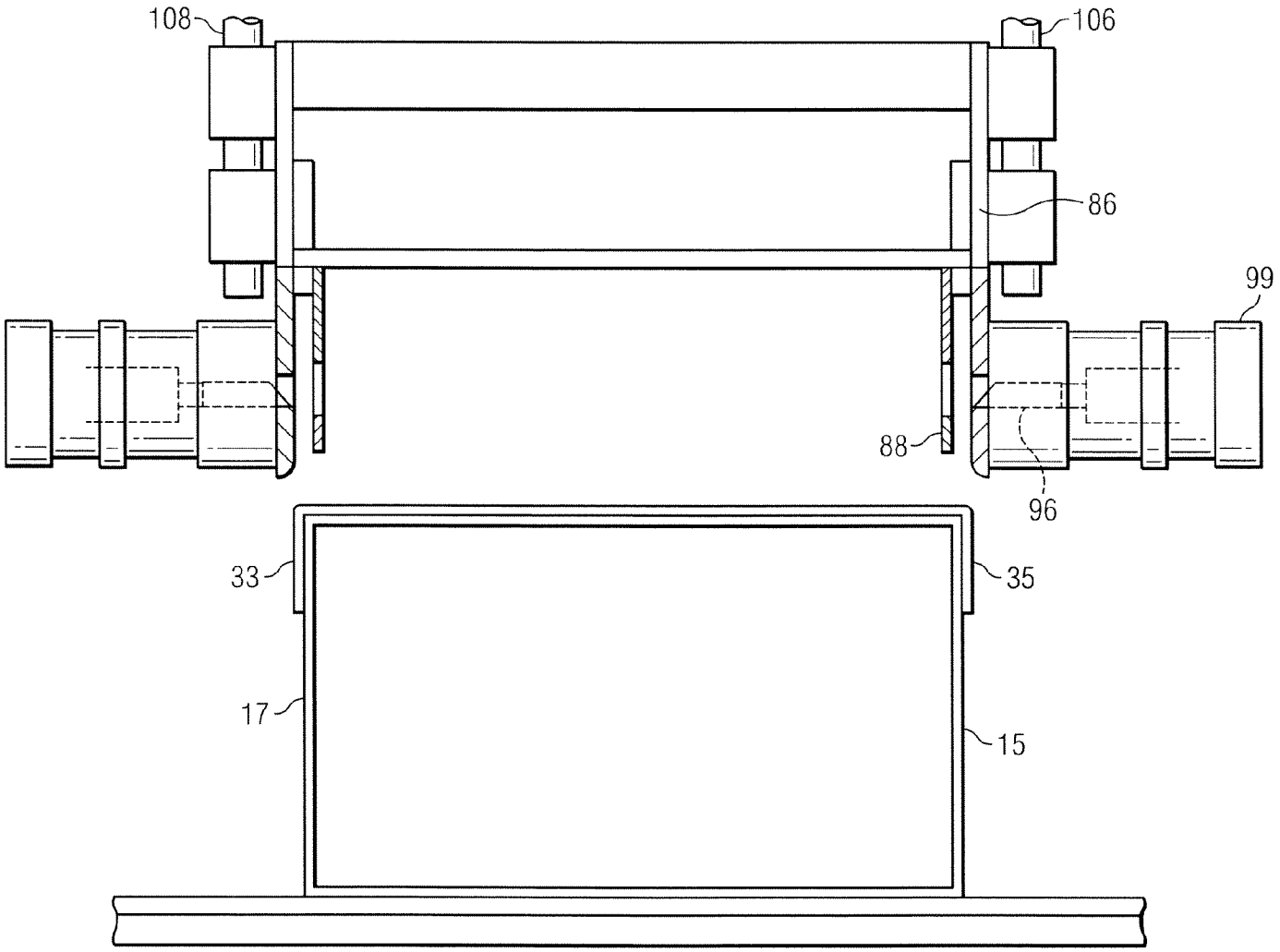
FIGS. 11-13 are simplified, schematic views of the various sequential steps in the method of the invention, showing the operative parts of a second version of the carton punching mechanism of the invention.

FIGS. 7-9 illustrate the principal components of one version of the carton closure station of the invention, as well as the various method steps employed in securing the carton top flaps. FIG. 10 is an isolated view of only the operative components of the first version of the closure mechanism of the invention. Thus, as illustrated in FIG. 7, the carton closure station of the invention is designed for receiving a cardboard carton of the type previously described with open top flaps which have been folded downwardly from an initially open position to a carton closing position which closes off the initially open interior of the cardboard carton. The outwardly extending ears (33, 35 in FIG. 7) of the now closed top flaps are also now folded down into a position in contact with a second set of opposing sidewalls 15, 17 of the carton intermediate the first set of opposing sidewalls 19, 21.

As will be apparent in the description which follows, the carton closing station has a carton punching mechanism for punching and forcing a first layer of cardboard from a respective top flap through an associated second layer of an underlying sidewall of the carton, whereby the second layer of cardboard forms a retainer for the respective flap ear to thereby secure the ear and flap to the respective sidewall of the carton.

FIG. 10 perhaps best illustrates the operative components of a first version of the carton punching mechanism of the invention. The punching mechanism includes a horizontal shaft 39 which is carried between a pair of spaced apart trunnions 41, 43. The shaft also carries a set of rotatable punches 45, 47 which are alignable with the now folded ears of the top flap of the carton, as will be further described. The rotatable punches 45, 47 have angularly bent, downwardly extending legs 49, 51 which terminate in inwardly extending die elements 53, 55. The die elements are in the nature of sharp teeth, capable of punching through at least two layers of cardboard. As will be apparent from the discussion which follows, the downwardly extending legs 45, 47 are rotatable about a pivot point or axis (generally at 57 in FIG. 10) for moving the die elements in an arcuate path both toward and then away from selected sidewalls of the carton.

As illustrated schematically in FIGS. 7-9, this version of the apparatus of the invention also includes an elevation mechanism for moving the punching mechanism with its rotatable punches along a vertical path of travel with respect to the carton located in the punching station. FIG. 7 illustrates the elevation mechanism as including vertically traveling carriages 77, 79 which are affixed to the trunnions (43 in FIG. 7). The carriages can be moved in a vertically reciprocal fashion by any suitable power means. The power means is illustrated schematically by the lower ends of the hydraulic cylinder shafts 80, 82, shown broken away in FIG. 7.

The traveling carriages also support a pair of spaced apart, vertically extending platens (59, 61 in FIGS. 7-10). The platens are stationarily mounted with respect to the horizontal shaft 39 and have sharpened downwardly extending points 63, 65. The platens 59, 61 also are provided with window openings, such as the openings 67, 69 shown in FIG. 10. The sharp points on the platens puncture the carton top upon downward vertical movement of the traveling carriages 77, 79. The platens 59, 61 are then located a selected distance inward within the box interior so as to underlie the inwardly extending die elements of the rotatable punches when the punch mechanism is thereafter actuated and the punches are rotated to punch the carton. As the punch elements rotate in the direction of the folded carton ears to punch first the carton ear and then the carton sidewall, the window openings 67, 69 underlie the punches and receive the inwardly extending die elements 53, 55 within the window openings.

In similar fashion, any suitable operational means may be provided for effecting operative, rotational movement of the punches and withdrawing action of same within a predetermined desired period. Such means may comprehend circuitry involving microswitches, etc., but such do not constitute a part of the present invention. It will, of course, be well understood that the pivoting action of the punches and reciprocal vertical travel or stroke of the entire assembly may be effected by any well known means, such as pneumatic, hydraulic, electro-mechanical and, if need be, by manually operated mechanical expedients. However, for purposes of the present disclosure, the punches are shown as being rotated on the shaft 39 by means of hydraulic cylinders (71 shown in FIG. 10) having output shafts 73 which acts through a suitable linkage 75 to effect the rotation of the punches.

While only one of the punch mechanisms is illustrated in FIG. 10, it will be understood that typically four of such mechanisms will be used in order to secure a carton having the configuration shown in the present drawings.

The operation of the first version of the closure mechanism of the invention will now be described principally with respect to FIGS. 7-9. FIG. 7 shows the previously formed carton with the top flaps folded down and with the initially outwardly extending ears folded in. The closure mechanism is in its top point of its vertical path of travel. Note that the downwardly extending platens 59, 61 are spaced a selected distance ("d" in FIG. 7) inwardly so that the platens can be received within the carton interior underlying the interior sidewall of the carton and beneath the folded carton ears.

FIG. 8 illustrates the next step in the first method of the invention in which the elevation mechanism is actuated, causing the punch mechanism to travel vertically downward. This can be accomplished by vertical movement of the vertically traveling carriages 77, 79. This action causes the downwardly extending points 65, 67 of the platens to penetrate the plane of the top flaps of the carton and be received within the carton interior adjacent the respective vertical carton sidewall and beneath the now folded ears 33, 35.

In the next step in the method of the invention, the punch mechanism hydraulic cylinders 71, 72 are actuated, causing the punches to be rotated, whereby the die elements 53, 55 penetrate the carton ears and the carton sidewalls, as shown in FIG. 9. The operative steps would then be reversed to complete the carton closure operation. In other words, the die elements would be retracted from the carton sidewalls and the power source associated with the carriage assembly (such as a fluid cylinder) would be actuated to move the punching mechanism vertically upward and away from the carton.

FIG. 6 shows the completed carton. Note that the first layer of cardboard made up of the carton ears 29, 31 is punched through the second layer of cardboard 17 comprising the carton vertical sidewall and thereby forms a retainer for the respective ear to thereby secure the ear and flap to the respective sidewall of the carton.

Figure 12:
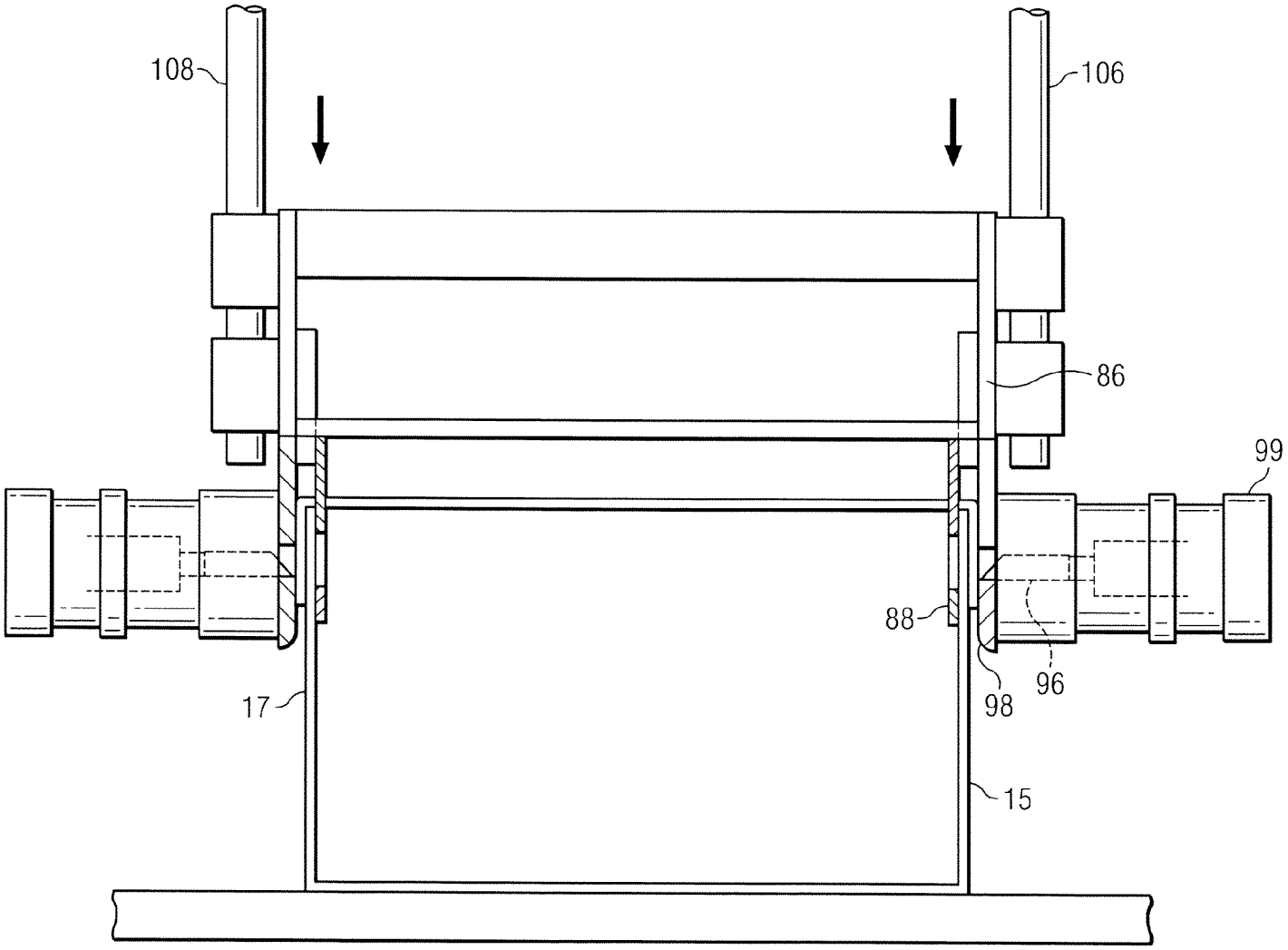
Figure 13:
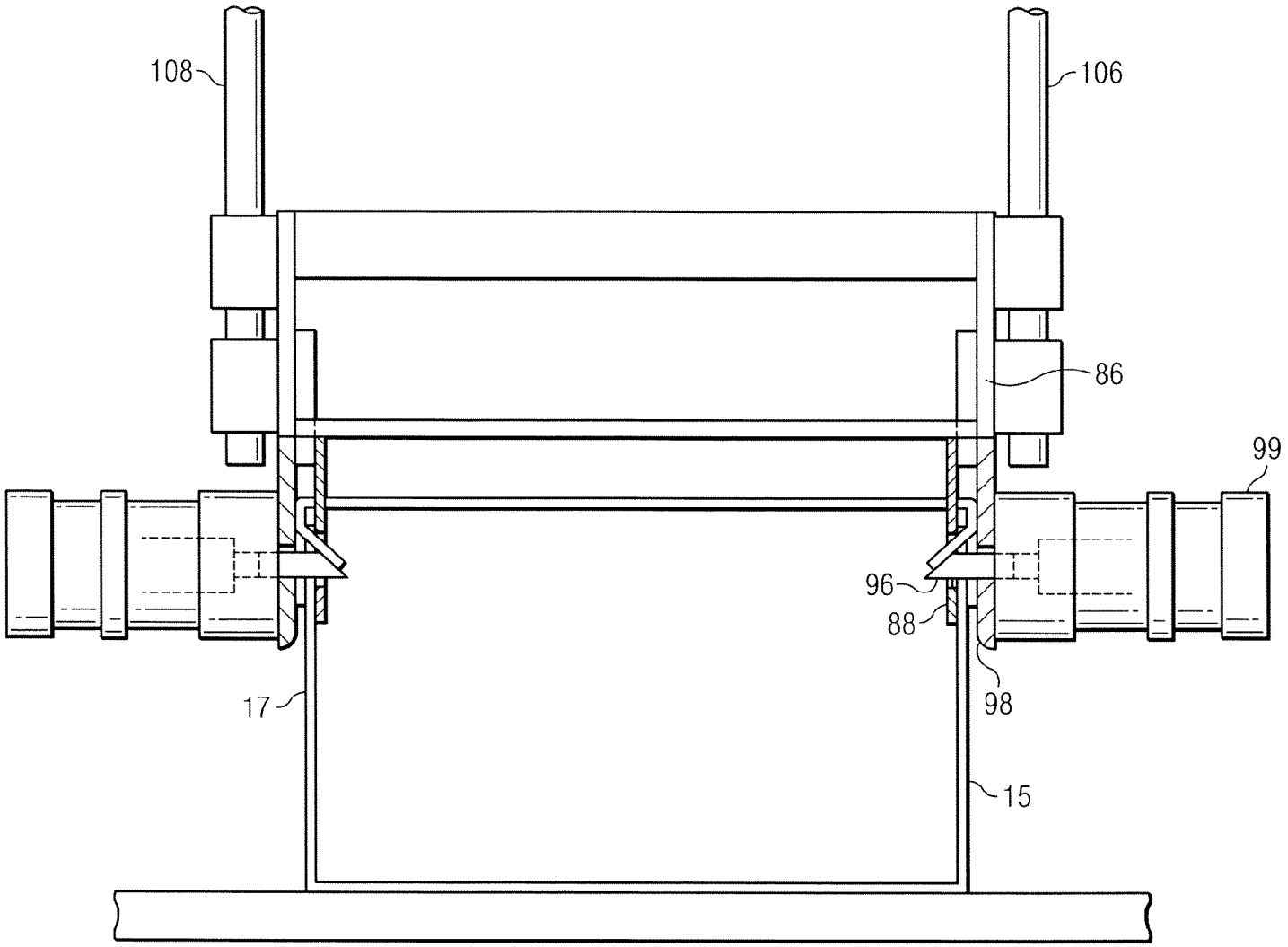
Figure 14:
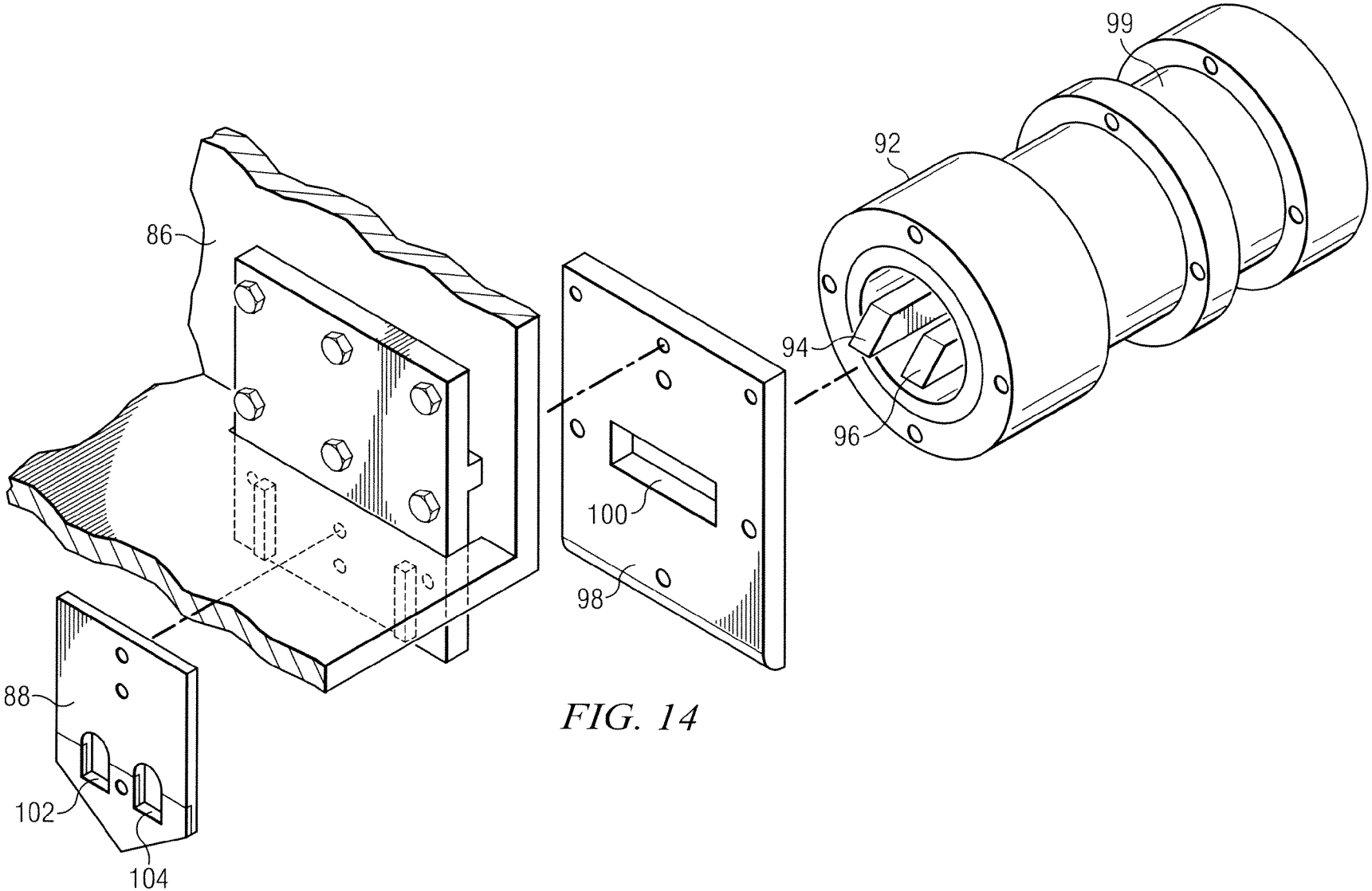
FIG. 14 is an isolated, close up view of the second version of the carton punching and engaging apparatus of the invention.

FIGS. 11-14 illustrate another version of the punching mechanism of the invention. With reference first to FIG. 14, the vertically movable carriage 86 again carries a pair of spaced apart, vertically extending platens (such as platen 88). In this case, however, a fluid cylinder 90 has an operative end 92 which carries the punch die elements 94, 96. A reinforcing plate 98 is located a selected distance opposite the platen 88 on the movable carriage. It has a horizontal slot 100 sized to receive the punch dies 94, 96. Actuation of the output shaft (shown in phantom lines in FIGS. 11-13) of the fluid cylinder 99 causes the punch die elements 94, 96, to move along a horizontal axis generally parallel to the bottom wall of the box. In this version of the invention, there is a simple linear back and forth action of the punches, rather than the previously described rotatable punching action. Otherwise, the two punching operations are substantially similar. The platen 88 again has window openings 104, 106, for receiving the punch die elements.

FIG. 12 shows the traveling carriage 86 supported on shafts 106, 108. Vertical, reciprocal movement of the shafts 106, 108, for instance in response to actuating a fluid cylinder, causes the assembly to move from the disengaged position shown in FIG. 11 to the carton engaging position shown in FIGS. 12 and 13. As the movable carriage moves vertically downward to the position shown in FIG. 12, the platens 88 puncture the carton top flaps so as to underlie the path of travel of the die elements 94, 96, as the carton closing operation proceeds.

FIG. 13 shows the punch die elements being actuated by the fluid cylinder 99. This action causes the punch die elements (94, 96 in FIG. 14) to punch the first layer of cardboard from a respective top flap, through the associated second layer of an underlying sidewall of the carton, and then through a respective opening in the underlying platen. In this way, the second layer of cardboard forms a retainer for the respective flap ear to thereby secure the ear and flap to the respective sidewall of the carton.

An invention has been provided with several advantages. The use of a punch mechanism in the carton closure method of the invention eliminates the need for gluing the carton top. This saves money on glue and also reduces the mess associated with the gluing operation. The mechanism of the invention is relatively simple in design and economical to implement and can be incorporated into a variety of existing packaging lines. The use of underlying platens reduces any tendency of the punch mechanism to bend or deform the carton and reduces the risk that any contents of the carton might be damaged during the top sealing operation. Because no glue is used, the punched carton regions can be opened and then resealed by hand.

While the invention has been shown in only one of its forms, it is not thus limited but is susceptible to various changes and modifications without departing from the spirit thereof.

We claim:

1. An assembly line mechanism for closing a cardboard carton where the carton has a bottom wall and integral sidewalls extending upwardly therefrom to define an initially open interior, the carton also having a top, the top having downwardly extending ears which have been brought to a position in contact with selected ones of the carton sidewalls with the sidewalls underlying the downwardly extending ears, the assembly line mechanism comprising:

a carton closing station for the aforesaid cardboard carton for temporarily supporting the cardboard carton in a stationary position within the closing station;

a punching mechanism provided as a part of the carton closing station, the punching mechanism including a set of punches which are alignable with the downwardly extending ears of the carton top, the punches being movable along a horizontal axis, generally parallel with the carton bottom wall, between retracted and extended positions;

whereby actuating the punches to move between the retracted and extended positions forms punch openings while simultaneously forcing a first layer of cardboard from a respective carton ear through an associated second layer of an underlying sidewall of the carton, whereby the second layer of cardboard forms a retainer for the respective carton ear to thereby secure the carton ear to the respective sidewall of the carton; and wherein the punching mechanism includes a set of spaced apart, vertically extending platens which underlie the punches as the punches are actuated to puncture the carton, the platens having window openings for receiving operative portions of the punches while, at the same time, reinforcing the carton interior as the carton closing operation proceeds.

2. The assembly line mechanism of claim 1, further comprising:

an elevation mechanism in the form of a vertically movable carriage for moving the carton punching mechanism along a vertical path of travel with respect to the carton located in the carton closing station.

3. The assembly line mechanism of claim 2, wherein the vertically extending platens are carried on the vertically movable carriage.

4. The assembly line mechanism of claim 3, wherein the punches terminate in die elements and wherein the set of spaced apart, vertically extending platens also are provided with window openings for receiving the respective die elements of the punches as the die elements punch the first layer of cardboard from a respective top flap through the associated second layer of an underlying sidewall of the carton and then through a respective opening in the underlying platen, whereby the second layer of cardboard and forms a retainer for the respective carton ear to thereby secure the ear and flap to the respective sidewall of the carton.

5. The assembly line mechanism of claim 4, further comprising:

a suitable power source for effecting movement of the punches, the power source being selected from the group consisting of pneumatic and hydraulic cylinders.

6. The assembly line mechanism of claim 1 wherein no glue is used.

* * * * *